US009188286B2

(12) United States Patent
Bulgarelli et al.

(10) Patent No.: US 9,188,286 B2
(45) Date of Patent: Nov. 17, 2015

(54) HYDRAULIC SYSTEM AND HYDRAULIC DISTRIBUTOR FOR THE ACTUATING WORKING MACHINES

(75) Inventors: Claudio Bulgarelli, Modena (IT); Massimo Riva, Modena (IT)

(73) Assignee: HYDROCONTROL S.P.A. CON UNICO SOCIO, Castel San Pietro Terme (IT)

( * ) Notice: Subject to any disclaimer, the term of this patent is extended or adjusted under 35 U.S.C. 154(b) by 436 days.

(21) Appl. No.: 13/702,952

(22) PCT Filed: Jun. 8, 2011

(86) PCT No.: PCT/IB2011/001266

§ 371 (c)(1),
(2), (4) Date: Feb. 14, 2013

(87) PCT Pub. No.: WO2011/154809

PCT Pub. Date: Dec. 15, 2011

(65) Prior Publication Data

US 2013/0139918 A1 Jun. 6, 2013

(30) Foreign Application Priority Data

Jun. 8, 2010 (IT) ..... BO2010A0358

(51) Int. Cl.

| | |
|---|---|
| ***F15B 11/16*** | (2006.01) |
| ***F17D 1/00*** | (2006.01) |
| ***E02F 3/32*** | (2006.01) |
| ***E02F 9/22*** | (2006.01) |

(52) U.S. Cl.

CPC . *F17D 1/00* (2013.01); *E02F 3/325* (2013.01); *E02F 9/2225* (2013.01); *F15B 11/163* (2013.01); *F15B 2211/30555* (2013.01); *F15B 2211/50536* (2013.01); *F15B 2211/6055* (2013.01); *F15B 2211/654* (2013.01); *Y10T 137/87917* (2015.04)

(58) Field of Classification Search

CPC ..... F15B 11/163; F15B 2211/30555; F15B 2211/50536; E02F 9/2225

USPC ..... 60/459; 91/446, 447

See application file for complete search history.

(56) References Cited

U.S. PATENT DOCUMENTS

| | | | | |
|---|---|---|---|---|
| 2008/0224073 | A1 * | 9/2008 | Christensen et al. | 251/58 |
| 2008/0245222 | A1 * | 10/2008 | Christensen et al. | 91/435 |
| 2008/0282691 | A1 * | 11/2008 | Bulgarelli et al. | 91/433 |

FOREIGN PATENT DOCUMENTS

| | | |
|---|---|---|
| GB | 2445094 | 6/2008 |
| GB | 2445095 | 6/2008 |

OTHER PUBLICATIONS

International Search Report and Written Opinion from the International Bureau European Patent Office dated Sep. 20, 2011, for International Patent Application No. PCT/IB2011/001266, Filed Jun. 8, 2011, Applicant, Hydrocontrol S.P.A. Con Unico Socio. (8 pages).

*Primary Examiner* — Thomas E Lazo
(74) *Attorney, Agent, or Firm* — McCracken & Gillen LLC

(57) ABSTRACT

Hydraulic system for actuating the hydraulic actuators of a working machine, the hydraulic system has a delivery, a discharge, a drainage line, a signal line, a main slide valve which actuates a corresponding hydraulic actuator, a safety slide valve integral with the main slide valve and adapted for opening or closing the drainage line itself, and a pressure compensator presenting a frontal chamber connectable by way of the main slide valve to the delivery and a rear chamber connected to the signal line; the drainage line connecting a node of the signal line to the discharge.

9 Claims, 2 Drawing Sheets

HYDRAULIC SYSTEM AND HYDRAULIC DISTRIBUTOR FOR THE ACTUATING WORKING MACHINES

The present invention relates to a hydraulic system and a hydraulic distributor for actuating working machines.

In particular, the present invention is advantageously applied to a hydraulic system for actuating a mini-excavator, to which the following discussion will explicitly refer without loss of generality.

PRIOR ART

A hydraulic system for actuating a mini-excavator, as the kind described, for example in the patent EP1860327E1, comprises a plurality of distributors, each of which controls a hydraulic actuator by means of a slide valve having an axially sliding spool. The movement of the spool of each slide valve can be generated by a hydraulic servo control controlled by a control lever actuated by the user or directly by means of a control lever actuated by the user (i.e. without the interposition of a hydraulic servo control), For economic reasons, in a mini-excavator, most distributors present slide valves directly controlled by a lever actuated by the user.

When a mini-excavator is put in a holding position ("standby"), the oil remains at a pressure of around 10-20 bar in the hydraulic system which represents a fraction of the nominal pressure but still sufficient to determine actuation (albeit slow) of the hydraulic actuators. As a result, an unintended displacement of a control lever that directly controls a slide valve can cause unwanted movement of the corresponding hydraulic actuator.

To prevent unwanted movement of the hydraulic actuators controlled by slide valves that are directly controlled by control levers, it is necessary to provide the appropriate mechanical locks that prevent such movements as the mini-excavator is put in a holding position. However, these mechanical locks are complex, expensive and bulky and require a rather complicated control logic (as it must be extremely reliable to ensure with a high margin of safety the security of the mini-excavator operators).

A hydraulic system for actuating a mini-excavator of the type described in the patent EP1660327B1 also comprises a discharge system for a signal line, which is connected to the actuators control slide valves. In particular, the discharge system described above comprises a drainage line and a compensator unit, which in turn comprises at least one slide valve and is interposed between the signal line and the drainage line itself. In particular, as shown in E21860327B1, the signal line is connected to the drainage line through a unit comprising a slide valve and a pressure compensator. The known discharge system of the signal line has the disadvantage of delaying the discharge of the signal line and to request, during the hydraulic system production, the execution of high-precision finishing operations (lapping) being time consuming and costly to produce.

Other hydraulic systems for actuating a mini-excavator are described in US2008/0224073 and US2008/0245222, but also these hydraulic systems have the disadvantage of delaying the discharge of the signal line.

DESCRIPTION OF THE INVENTION

The aim of the present invention is to provide a hydraulic system and a hydraulic distributor for actuating working machines, which allow to eliminate the above described drawbacks being at the same time of easy and economical construction.

According to the present invention a hydraulic system, and a hydraulic distributor is provided as defined within the appended claims.

BRIEF DESCRIPTION OF THE DRAWINGS

The invention will now be described with reference to the annexed drawings, which illustrate a non limitative embodiment, in which.

PREFERRED EMBODIMENTS OF THE INVENTION

Figure 1:
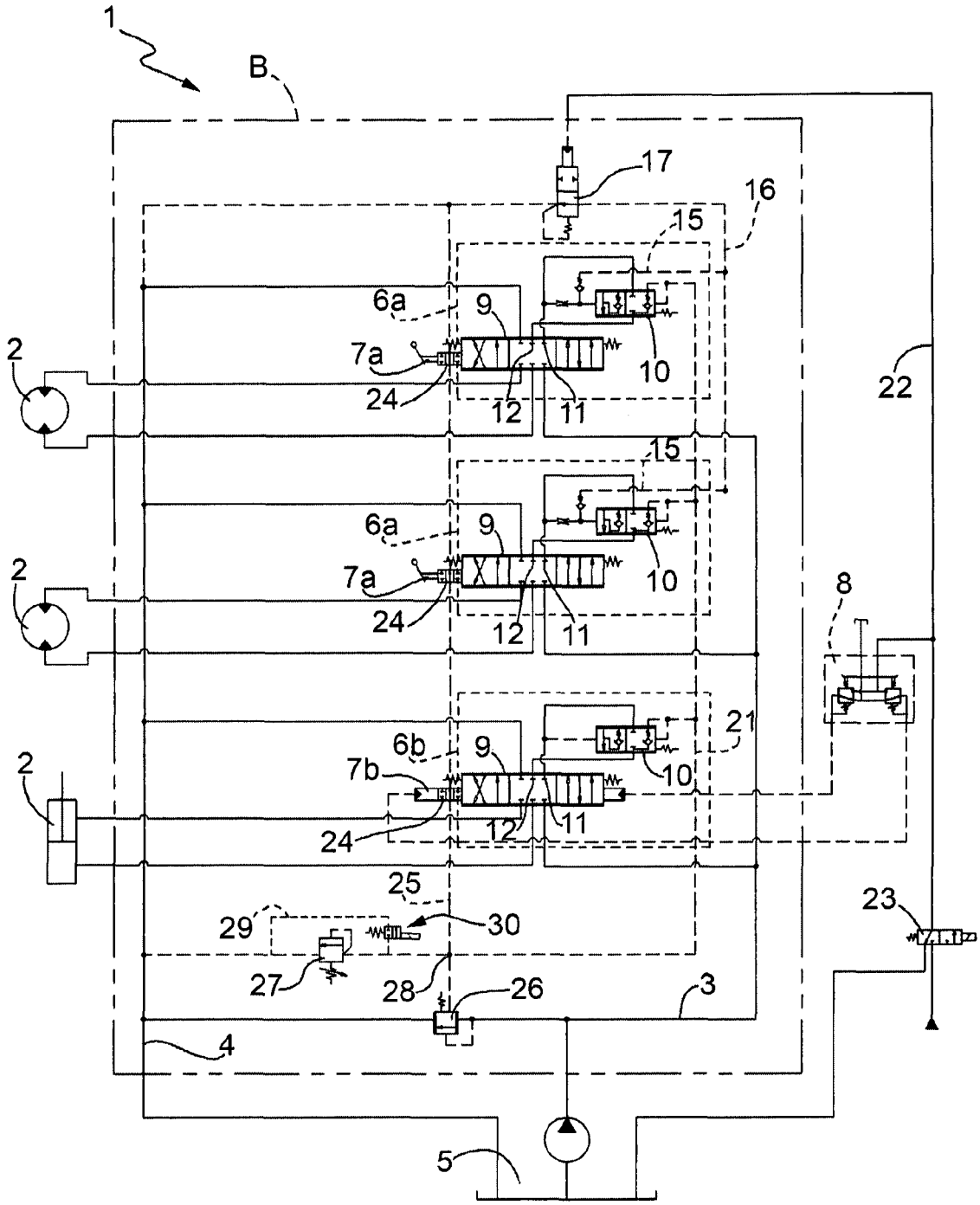
FIG. 1 is a schematic view with parts removed for clarity of a preferred embodiment of the hydraulic system of the present invention.
Figure 2:
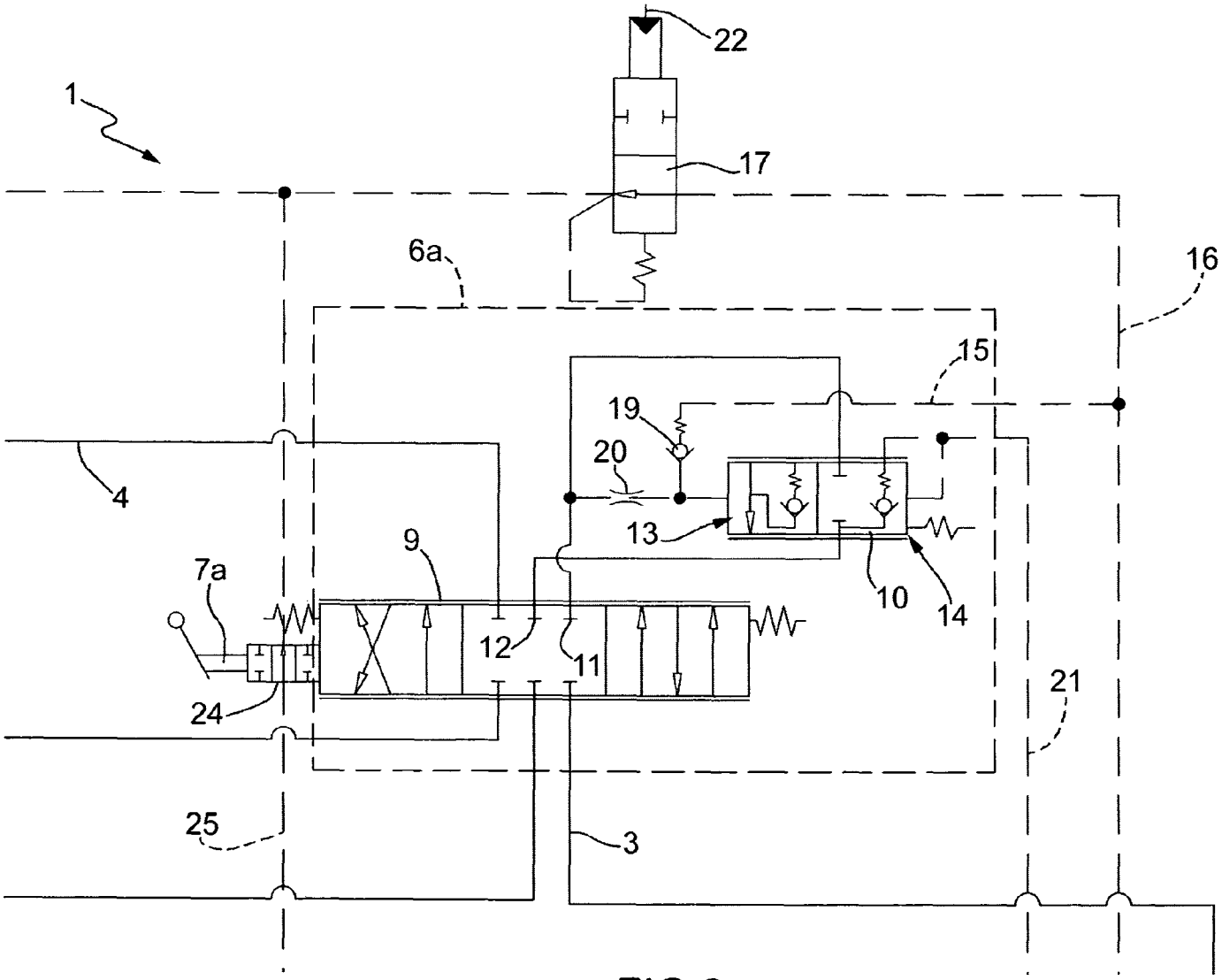
FIG. 2 illustrates on an enlarged scale a detail of the hydraulic system of FIG. 1.

In FIG. 1, with number 1 is indicated, as a whole, a hydraulic system for actuating a plurality of hydraulic actuators 2 for working machines (not shown). The hydraulic system 1 comprises a high-pressure oil delivery 3, a discharge return line 4 and a low-pressure oil discharge 5.

The hydraulic system 1 also comprises a plurality of distributors 6, each of which is associated with a respective actuator 2 for adjusting the feeding modality of oil to the actuator 2 itself, as will be explained more fully below.

The hydraulic system I comprises a plurality of controls 7, each of which regulates the operation of the respective distributor 6. Some distributors **6*a* (only two of which are illustrated in FIG. 1) are directly controlled by the user manually operating the respective control levers, each of which is mechanically connected to a corresponding control 7*a*. Other distributors 6*b* (only one of which is shown in FIG. 1) are indirectly controlled by the user through the interposition of a hydraulic servo control 8; in this case, each distributor 6*b* comprises a control 7*b* hydraulically actuated by a hydraulic servo control 8**.

As shown in FIG. 1, each distributor 6 comprises a main slide valve 9, which is actuated by the respective control 7 and is provided with an axially sliding spool, and a pressure compensator 10.

The compensator 10 is hydraulically connected to the main slide valve 9, has a main inlet 11 connectable through the main slide valve 9 to the main delivery 3 and a main discharge 12 which is connectable by way of the main slide valve 9 to the corresponding hydraulic actuator 2. In addition, the compensator 10 has a frontal chamber 13 which is permanently connected to the delivery 11, and a rear chamber 14 which is connectable with the discharge 5, as will be explained more fully below.

Note that each distributor **6*a* actuated by a control 7*a* controlled by a manual control lever also comprises a drainage line 15, which connects the front chamber 13 of the compensator 10 to the discharge 5** during a stand-by phase, as will be explained more fully below.

Each distributor **6*a* actuated by a control 7*a* controlled by a manual control lever comprises a gauged throttle 19 arranged upstream of the frontal chamber 13 between the inlet 11 and the drainage line 15; the function of the gauged throttle 19 is to limit the amount of oil under pressure flowing towards the outlet 5 through the drainage line 15** to increase the overall energy efficiency.

Each distributor 6*a* actuated by a control 7*a* controlled by a manual control lever also comprises a one-way valve 20 arranged along the drainage line 15; the function of the one-way valve 20 is to prevent oil reflux and improves the functioning and actuation accuracy of the compensator 10.

As shown in FIG. 1, the hydraulic system 1 comprises a plurality of distributors 6*a* controlled by respective manual control levers and the frontal chambers 13 of respective compensators 10 are connected through the corresponding drainage lines 15 to the same common drainage line 16. The hydraulic system 1 also comprises a drainage valve 17 that is arranged along the common drainage line 16 and is adapt for opening or closing the common drainage line 16.

As shown in FIG. 1, the hydraulic system 1 also comprises an activation line 22, which is fed with oil at a pressure generally less than that of the oil which is present in the delivery 3 and is hydraulically connected to the drainage valve 17 and to the servo control 8; and an activation valve 23 that connects or isolates the activation line 22 from the feeding of pressurized oil, thus regulating the opening or closing of the drainage valve 17 and the activation of the servo control 8.

As illustrated, the hydraulic system 1 also comprises:

a signal line 21 connected to the rear chamber 14 of each compensator 10;

a secondary drainage line 25 connected to the discharge 5, and a safety slide valve 24 for each distributor 6.

The safety slide valve 24 is integral with a respective main slide valve 9, is arranged along the secondary drainage line 25, and is actuated by a respective control 7 for opening or closing the secondary drainage line 25. All the safety slide valves 24 are interconnected in series along the secondary drainage line 25; each safety slide valve 24 does not interrupt the secondary drainage line 25 when the corresponding main slide valve 9 is held in a stand-by position while it interrupts the secondary drainage line 25 when the corresponding main slide valve 9 is arranged in a different position from the stand-by position.

As shown in FIG. 1, the secondary drainage line 25 connects a node 28 of the signal line 21 to the discharge 5. The drainage line 25 is connected to the signal line 21 and in correspondence to the node 28 upstream (with respect to the direction of oil circulation) of the safety slide valves 24. In other words, the node 28 is upstream, with respect to the direction of oil circulation in the drainage line 25, of the safety slide valves 24. In this way, the hydraulic system 1 allows a faster discharge of the signal line 21 with respect to known type hydraulic systems as the signal line 21 is directly connected to the drainage line 25, when all the safety slide valves 24 are in the closed position (i.e. when all the main slide valves 9 are in the stand-by position). By saying that the drainage line 25 is connected directly to the node 28 of the signal line 21 it means that the drainage line 25 is connected to the node 28 of the signal line 21 without the interposition of any other device.

The hydraulic system 1 further comprises:

a pressure regulator 26 which is fed from the delivery 3 and is connected to the node 26 of the signal line 21;

a pressure limiter 27, which is adapted for connecting the node 28 of the signal line 21 to the discharge 5;

an auxiliary drainage line 29 connecting the node 28 of the signal line 21 to the discharge 5, and an auxiliary slide valve 30 which is electrically actuated and is interposed along the auxiliary drainage line 29 for opening or closing the auxiliary drainage line 29 itself.

According to that shown in FIG. 1, the hydraulic system 1 comprises a plurality of distributors 6 grouped together in one body, so as to form a distribution block B (of a known type and schematically illustrated); the number of distributors 6 matches the number of hydraulic actuators 2 fed by the hydraulic system 1. Typically, a mini-excavator is adapted for feeding from 9 to 12 actuators. Each distributor 6 has, in a known way and schematically illustrated, a plurality of connecting elements such as to allow the flow of oil from a distributor 6 to an adjacent one, as shown in the diagram of FIG. 1.

Each drainage line 15, the common drainage line 16, the signal line 21 are made as control ducts (secondary) and illustrated by dashed lines; in other words, the drainage line 15, the common drainage line 16 and the signal line 21 present reduced sections and are adapt for the passage of a small amount of oil that is used to regulate the operation of the compensators 10. While the delivery 3 is made as a power duct (primary) and adapted for transferring a flow of oil at sufficient pressure to actuate the actuators 2.

In use, the hydraulic system 1 for actuating a mini-excavator is fed with oil at a pressure between 190-240 bars; while, during a "standby" or idle phase (shown in FIG. 1), the oil pressure in the delivery 3 is maintained between 10-20 bar.

To prepare the hydraulic system 1 according to the stand-by configuration shown in FIG. 1, the activation valve 23 is de-energized (i.e., deprived of electrical power) and then arranged in a position in which it connects the activation line 22 to the discharge 5. In this condition, the activation line 22 is devoid of hydraulic pressure being connected to the discharge 5; as a result, the actuator 8 is not able to operate as it is lacking the necessary hydraulic pressure (and therefore any action exerted on the servo control 8 does not produce any effect on the corresponding distributors 6*b* and, consequently, the corresponding hydraulic actuators 2). Furthermore, when the activation line 22 is without hydraulic pressure, the hydraulically controlled drainage valve 17 is arranged in the closed position (the drainage valve 17 is normally closed) consequently determining the connection to the discharge 5 of all the frontal chambers 13 of compensators 10 of distributors 6*a;* therefore acting also upon the controls 7*a* of distributors 6*a* it is not possible to obtain any movement of the corresponding hydraulic actuators 2 since their respective compensators 10 are rendered completely inactive by the connection to the discharge 5 of the front chambers 13. In other words, in case of actuating (accidentally or intended) of a control 7*a* controlled by a manual control lever such as to bring the corresponding main slide valve 9 in a working position and the hydraulic system 1 is in a stand-by mode, the pressurized oil sent from the delivery 3 to the frontal chamber 13 of the compensator 10 is diverted through the drainage line 15 towards the discharge 5. In this way the actuation of the compensator 10 is inhibited, which remains in the stand-by position preventing the passage of oil to the corresponding actuator 2.

As gathered from the above disclosure, the above described hydraulic system 1 allows the complete inhibition by way of less expensive regulatory elements of hydraulic type and of easy and fast deployment, of the actuation in the stand-by phase of an actuator 2 actuated by a control 7*a* controlled by a manual control lever.

It is further seen that the implementation of a hydraulic system 1 in which the signal line 21 is directly connected to the secondary drainage line 25 increases the discharge and the reaction speed of the hydraulic system 1, as well as facilitating and speeding up production time and lowering production costs (fewer mechanical components to be employed in the hydraulic system and fewer finishing operations, such as lapping, to be undertaken).

Therefore, the hydraulic system 1 increases the security of a mini-excavator, ensuring the inhibition of each actuator 2 in stand-by phase, avoiding the use of mechanical locking devices or complicated logic controls.

The invention claimed is:

1. Hydraulic system for actuating the hydraulic actuators of a working machine, the hydraulic system comprises:

a high-pressure oil delivery;

a low-pressure oil discharge;

at least one first slide valve which comprises a first spool, which is axially sliding, and controls a first hydraulic actuator;

a first control which can be directly actuated by an operator by means of a control lever and controls the position of the first spool of the first slide valve; and a first pressure compensator which is hydraulically connected to the first slide valve, has a main inlet, which can be connected to the delivery by means of the first slide valve, and a main outlet, which can be connected to the first hydraulic actuator by means of the first slide valve, and presents a frontal chamber which determines the control of the pressure compensator and is permanently connected to the main inlet;

the hydraulic system comprising a first drainage line, which connects the frontal chamber of the first pressure compensator to the discharge and is provided with a drainage valve which is actuated in order to open or close the first drainage line the hydraulic system being characterised in that is comprises:

a signal line which is connected to a rear chamber of the first pressure compensator;

a second drainage line which connects a node of the signal line to the discharge; and a third safety slide valve comprising a third spool which is fixed to the first spool of the first slide valve, is axially sliding and is interposed along the second drainage line in order to close or open the second drainage line itself.

2. Hydraulic system according to claim 1, and comprising an activation valve which controls the position of the drainage valve.

3. Hydraulic system according to claim 2, wherein:

the drainage valve is hydraulically actuated in function of the pressure of the oil in an activation line; and the activation valve selectively connects the activation line to the discharge or to an intermediate-pressure oil delivery.

4. Hydraulic system according to claim 2, and comprising:

a second slide valve which comprises a second spool, which is axially sliding, and controls a second hydraulic actuator; and a hydraulic servo control which controls the position of the second spool of the second slide valve by means of a second control and is enabled and disabled by the action of the activation valve.

5. Hydraulic system according to claim 1, and comprising a gauged throttler which limits the flow rate of oil flowing through the first drainage line.

6. Hydraulic system according to claim 5, wherein the gauged throttler is arranged upstream of the frontal chamber between the main inlet of the first pressure compensator and the first drainage line.

7. Hydraulic system according to claim 1 and comprising a one-way valve arranged along the first drainage line.

8. Hydraulic system according to claim 1 and comprising:

a plurality of first slide valves, each of which comprises a first spool, which is axially sliding, and controls a corresponding first hydraulic actuator;

a plurality of controls, each of which can be actuated by an operator by means of a respective control lever and directly controls the position of the first spool of a corresponding first slide valve; and a plurality of first pressure compensators, each of which is hydraulically connected to a corresponding first slide valve and presents a frontal chamber which is connected to a same first drainage line common for all the first pressure compensators.

9. Hydraulic distributor for a hydraulic system of the type claimed in claim 1.

* * * * *